US006179746B1

(12) United States Patent
Delman

(10) Patent No.: US 6,179,746 B1
(45) Date of Patent: Jan. 30, 2001

(54) ACTIVITY CONTROLLED AUDIO-VISUAL SYSTEM

(76) Inventor: David Harris Delman, 71 Birchwood Park Dr., Jericho, NY (US) 11753

( * ) Notice: Under 35 U.S.C. 154(b), the term of this patent shall be extended for 0 days.

(21) Appl. No.: 09/334,849

(22) Filed: Jun. 17, 1999

(51) Int. Cl.[7] ..... A63B 69/00
(52) U.S. Cl. ..... 482/6; 482/2; 482/902
(58) Field of Search ..... 482/1–9, 51, 54, 482/57, 900–902; 348/61, 730; 434/247

(56) References Cited

U.S. PATENT DOCUMENTS

| | | | | |
|---|---|---|---|---|
| 4,298,893 | | 11/1981 | Holmes . | |
| 4,512,567 | | 4/1985 | Phillips . | |
| 4,542,897 | | 9/1985 | Melton et al. . | |
| 4,566,033 | | 1/1986 | Reidenouer . | |
| 4,637,605 | | 1/1987 | Ritchie . | |
| 4,976,435 | | 12/1990 | Shatford et al. . | |
| 5,001,632 | | 3/1991 | Hall-Tipping . | |
| 5,142,358 | | 8/1992 | Jason . | |
| 5,246,411 | * | 9/1993 | Rackman et al. | 482/57 |
| 5,362,069 | | 11/1994 | Hall-Tipping . | |
| 5,456,648 | * | 10/1995 | Edinburg et al. | 482/4 |
| 5,591,104 | | 1/1997 | Andrus et al. . | |
| 5,839,990 | | 11/1998 | Virkkala . | |
| 5,896,164 | * | 4/1999 | Orbach et al. | 482/902 |
| 6,004,243 | * | 12/1999 | Ewert | 482/8 |

OTHER PUBLICATIONS

From newpaper Newsday, Apr. 22, 1999 p. A28 Nassau County, N.Y.

* cited by examiner

*Primary Examiner*—Glenn E. Richman
(74) *Attorney, Agent, or Firm*—Levisohn, Lerner, Berger & Levisohn

(57) ABSTRACT

An activity controlled audio-visual system is disclosed. A device for connecting exercise equipment such as a pedal exerciser to a user sensory interface, such as a television set or computer so that the user has to pedal at a rate above a preset rate or threshold rate in order to be able to view the user sensory interface signal. The act of pedaling above a preset rate turns on a switch box which controls the input to the user sensory interface. In this way a normally sedentary activity such as watching television or a video, playing a video game, or using a computer is converted to one that requires physical activity.

18 Claims, 2 Drawing Sheets

ACTIVITY CONTROLLED AUDIO-VISUAL SYSTEM

CROSS-REFERENCE TO RELATED APPLICATIONS

Not applicable.

BACKGROUND—FIELD OF INVENTION

The present invention relates to audio-visual systems, specifically to such a device which will require a level of physical activity be maintained in order for the user to experience audio-visual information such as from broadcasts, playing videos or video games and thus adding a physical activity to an otherwise sedentary one.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

It is a well known fact that children and young adults watch too much television and play too many video games at the expense of getting enough physical activity. Various types of systems coupling exercise equipment to a television are well known in the art. In spite of numerous earlier patents and applications, such products are still not available in fitness, toy stores, electronic or computer shops. Past patents have not satisfied the requirements of being inexpensive, easy to use, and readily available. Solutions of the following types have been presented in earlier patents.

Perhaps the first one of these solutions is that of U.S. Pat. No. 4,298,893 to Hohnes in which an exercise bicycle is used to generate electricity to power a television set. While it is simple in theory, it is not inexpensive or easy to implement.

In U.S. Pat. No. 4,542,897 to Melton et al., a circuit allows the play of a video game if the user maintains a predetermined level of physical effort. This is a complex dedicated system that is not easily adapted for use in a home setting.

In U.S. Pat. No. 5,591,104 to Andrus et al., a physical exercise machine is connected to a video system through the use of a computer and the resultant effect is used to control the load resistance imposed in opposition to the movement of the pedals while optionally participating in a video game. This is a complex system that is not easily configured for economical home use.

The system shown in U.S. Pat. No. 4,976,435 to Shatford et al., is a complex device which allows the user to play video games while exercising thus missing a most important target goal of being inexpensive and easily used.

An interface to game console using game software. In U.S. Pat. No. 4,512,567 to Phillips and U.S. Pat. No. 4,637,605 to Ritchie, describe equipment that allow playing a video game while using an the exercise bicycle as long as the bicycle is being pedaled fast enough. The utility of these systems is questionable since they require the use of a specially designed bicycle or complicated mechanical add ons.

U.S. Pat. No. 5,001,632 to Hall-Tipping discloses a combination of a video game system and an exercise device whereby the play action is controlled by reference to the exerciser's heart rate and the output level of the exercise device. In U.S. Pat. No. 5,362,069 to Hall-Tipping the difficulty level of the exercise is controlled in an interactive fashion. Both systems are complex and expensive.

Apparatus for connecting an exercise bicycle to a computer U.S. Pat. No. 5,839,990 to Virkkala, describes an electronic circuit for connecting an exercise bicycle to a computer allowing the user to play some computer games and control the speed of a character in the game. While this apparatus solves some of the deficiencies of the other systems noted, it requires the use of a computer and it does not work with television or other audio-visual systems.

There have been devices in the past which attempt to restrict the amount of time television is watched but these involved the use of a token operated system as in U.S. Pat. No. 4,566,033 to Reidenouer. This system has a number of pitfalls such as the possible pooling of and selling of tokens and the fact that it controls the power source of the device. Most modem equipment will not function properly if they are totally disconnected from their power source. This is certainly not an appropriate method for control of devices such as audio-video tape players, computers or video games which can be damaged by this technique.

The system described in U.S. Pat. No. 5,142,358 to Jason is another complicated circuit which is not easily implemented and again since it controls the power source of the device is not suitable for such things as tape players, computers, video games or even modem televisions which have functions that require an uninterrupted source of power.

Regardless of how well the earlier inventions perform in their intended environment, none of them are suitable if the user wishes to employ an activity such as bicycling or other exercise in a home environment in an economical and easy to use way. These prior systems have been complicated, expensive, and not easily implemented, thus severely limiting their use.

SUMMARY OF THE INVENTION

It is therefore an object of this invention to provide a simplified and inexpensive system that can be easily hooked up between a user sensory interfaces's input connection such as that on a television, radio, speaker, audio cassette or disc player or even a computer and the input signal such as the antenna, cable system, audio-video player, video game, audio signal or computer CPU, which will permit the use of the user sensory interface only when the user is physically active.

It is an another object of the invention to provide a physical activity audio-visual system that is low cost thus will make it more widely available because it will be economical to purchase, thus it will be able to help more people.

It is an another object of the invention to provide a physical activity audio-visual system that is simple in its design so that it makes it easy to manufacture, assemble, and use.

It is an another object of the invention to provide a physical activity audio-visual system that requires no other expensive or complicated equipment be used or purchased.

It is an another object of the invention to provide a physical activity audio-visual system that its use will not damage sensitive electronic and electro-mechanical devices.

It is an another object of the invention to provide a physical activity audio-visual system that can be easily adapted for a wide range of exercise equipment.

It is an another object of the invention to provide a physical activity audio-visual system that can be added on to a variety of equipment by the end user or be an integral part of the original equipment manufacture.

The above and other objects and advantages are fulfilled by the invention, which is an activity controlled audio-visual system, activated by a physical activity, typically but not limited to exercise on a piece of exercise equipment. The system includes an input signal source such as from a television signal, video player, audio player, video game or computer. A user sensory interface such as a speaker, television or computer monitor is used to interface or convey the input signal information to the user. A means to control how or whether the input signal is connected to the user sensory interface. This is typically, but not limited to a switch box that has input, output and control connections and is connected in between the input signal source and the user sensory interface such that the switch box can turn on and off the input signal based on the state of the switch box. The state of the switch box is dependant on the signal presented to its control input by a sensor which monitors the physical activity. The term switch box is used to describe a means to control the input signal in relation to the user sensory interface and to the sensed activity. It may be a separate circuit or device from the other components of the invention or may be built into, or as part of, the signal source, user sensory interface, sensor device, or activity device.

Thus, in addition to a system which can be attached to an existing piece of exercise equipment or be adapted to work with any activity requiring some physical effort and which controls an existing user sensory interface, the invention further includes any system in which any or all of its components, ie. the physical activity device, the input signal source, the user sensory interface, the switch box and/or the sensor become an integral part of the original equipment manufacture of the respective component.

The sensor and switch box can be used with an existing user sensory interface and input signal source as in a device made to be connected between a television and its usual antenna input connection. This is designed to be easily added on by the end user and can have its own activity device such as a pedal exerciser or the sensor can be made to sense the motion of a piece of exercise equipment already in the home.

DETAILED DESCRIPTION OF THE PREFERRED EMBODIMENTS

Figure 1:
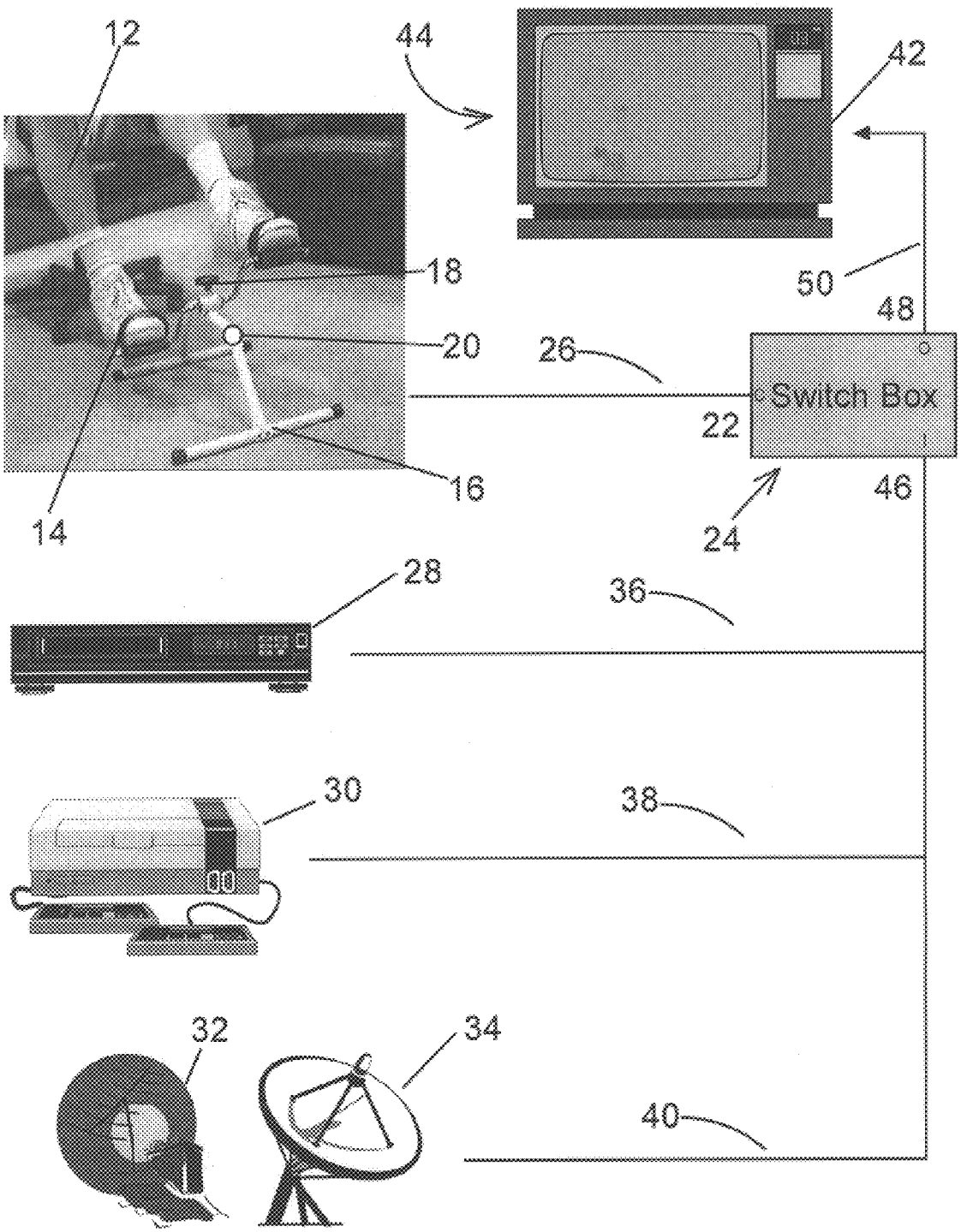
FIG. 1 represents one embodiment of the present invention in relation to a cycling type of exercise used to control video player, video games and television viewing.

Description of the invention will now be given with reference to FIGS. 1–3.The invention includes a system which is connected to a piece of exercise equipment and a user sensory interface. The illustration in FIG. 1 shows how the system is connected to a pedal exerciser. The user 12 sits on a chair (not shown) placing their feet on pedals 14 of the pedal exerciser 16. The effort required to pedal is typically adjusted by changing the friction provided by the tension screw 18. The speed sensor 20 is mounted on the pedal exerciser in such a way that the periodic motion of the pedaling can be monitored. The sensor 20 is connected to the Control input 22 of switch box 24 via connection 26 which represents any number of conventional means, such as wires, by wireless radio transmitters an receivers, by photo-optical means, and the like. All of the user sensory interface signal sources, ie. audio-video player 28, video game 30, antenna 32 and satellite/cable signal 34 are hooked together in their usual fashion as depicted by their respective connections 36, 38, and 40. Instead of being connected directly to the input 42 of the user sensory interface 44 however, they are connected to the input 46 of the switch box 24. The output 48 of the switch box 24 is then connected to the user sensory interface input 42 in the usual fashion as depicted by connection 50. In this way the user sensory interface 44 will not display a picture or sound unless the switch box 24 is turned on. The switch box 24 is turned on when the exercise performed on the pedal exerciser 16 is above a preset rate.

Figure 2:
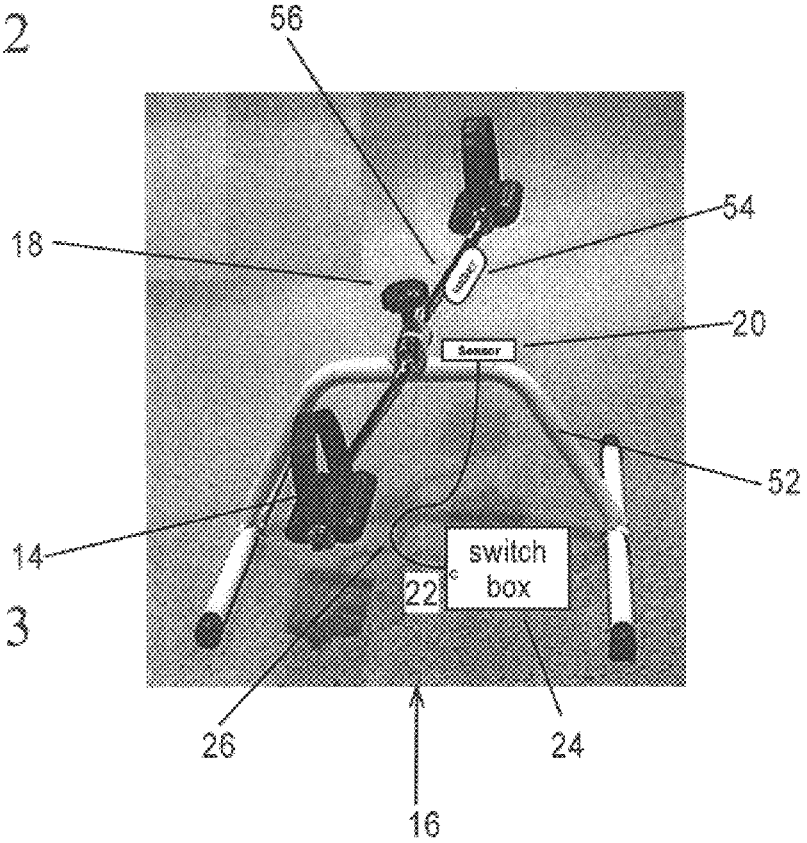
FIG. 2 shows an exemplary embodiment of a pedal exerciser and sensor.

FIG. 2 shows an exemplary embodiment of the pedal exerciser 16 and the speed sensor 20. The sensor 20 typically consists of a magnetic reed switch that is mounted to the fixed chassis 52 of the pedal exerciser 16. A magnet 54 is mounted on the rotating pedal crank 56 in such a way that as the crank 56 is rotated the magnet 54 comes in close proximity of the reed switch sensor 20. This causes the reed switch 20 to close a circuit and send a signal to the control input 22 of switch box 24 via connection 26, proportional to the rate at which the user is pedaling. When the switch box senses that the signal rate is above the preset rate it turns on allowing input signals connected to input 46 to flow to the output 48 and into the user sensory interface 44 via user sensory interface 42 (see FIG. 1).

Figure 3:
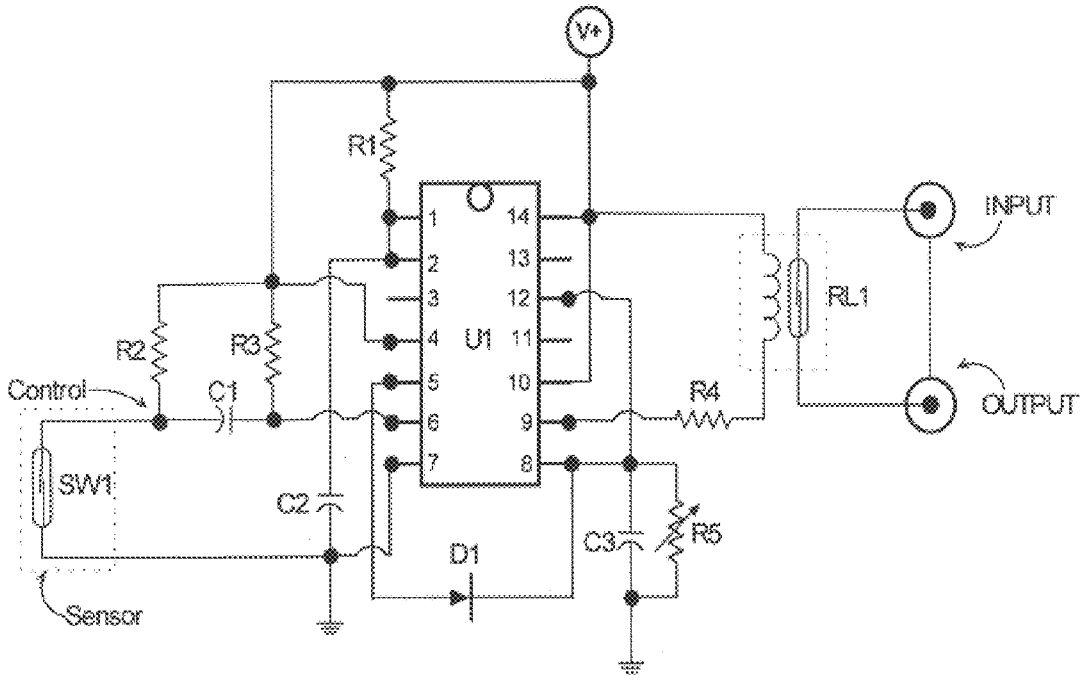
FIG. 3 shows a schematic view of an exemplary embodiment of the switch box circuit.

FIG. 3 shows a schematic view of an exemplary embodiment of the switch box circuit that controls whether or not the input signal connected to the user sensory interface. U1 a 556 dual timer integrated circuit. The first half of the dual timer, U1 is used as a monostable circuit triggered by the sensor 20, in this case shown as SW1 a magnetic reed switch. Resistors R2 and R3 and capacitor C1 shape the sensor signal and prevent the output of the first timer from remaining high if the pedals are fixed in a position with the magnet in proximity of SW1. Resistor R1 and capacitor C2 determine a the width of the output pulse from the first timer. This output pulse is then integrated by capacitor C3. The second half of the dual timer U1, is used as a comparator and powers the relay RL1 through current limiting resistor R4. Variable resistor R5 determines the minimum rate at which pedaling must be maintained, to keep the switch box turned on. When this rate is exceeded relay RL1 is activated thus connecting the input connector, INPUT to the output connector, OUTPUT. This allows the input signals to be viewed on the user sensory interface. The circuit is energized with a direct current source, with an optional power switch (not shown), via connections V+ and ground respectively.

In this preferred embodiment, the invention would be used to encourage physical activity by requiring a predetermined minimal amount of pedaling rate by the user on a pedal exerciser before the user could view the desired program ie., video game, audio-video player, television, and cable program. This predetermined rate can be adjusted by the user or a supervising person.

Additional Embodiments

While my above description contains many specificities, these should not be construed as limitations on the scope of the invention, but rather as an exemplification of one preferred embodiment thereof. Many other variations are possible. Additional embodiments include physical activity sensors configured to be used with other types of activities such as a pedal exerciser, a bicycle, a tread mill, an elliptical cycle, a strength training machine, a rowing machine, a stair climber, a skiing machine, a stepper machine, a weight lifting machine, a resistance training machine, a recumbent cycle, a repetitive task, a physical task, a household chore, a musical instrument and singing.

Another embodiment is a system in which the sensor is chose from those that detect magnetic, photo-optical, pressure, mechanical, strain, fluid flow, or sound.

Another embodiment is a system in which the user sensory interface would display a blank screen or a video or audio message such as "pedal faster" or an alternate audio-visual signal or connect to an alternate input signal source when the user is not exercising above the threshold rate.

Additional parameters of physiological activity may be used as the control factor for the switch box such as rate of exercise, rate of activity, force of activity, work of activity, heart rate, pulse rater, oxygen consumption, respiratory rate, carbon dioxide production, electrocardiographic information, electroencephalographic parameters, electro-retinographic data, galvanic skin response, sound volume and sound tone.

Additional control over the parameters used to activate the switch box can come from a secure, coded or keyed switch which would allow a supervising person to control the level of activity needed to turn the switch box on or off. The system can also include over ride and timed modes in which the switch box is always on, always off or on or off for specific amounts of time or during specific times of the day. Certain control parameters may be adjusted by the user also.

Another embodiment is a system in which the user interface is a computer and the switch box can turn on and off the video monitor as a function of the control signal.

Another embodiment is a system in which additional information is displayed in a window on the user sensory interface either in a numerical or graphical format and may include rate of activity, duration of activity, speed distance traveled, calories burned.

Another embodiment is a system in which the user interface is a telephone and the switch box can turn on and off the ability to carry on a conversation. This would have the dual benefits of limiting telephone use while at the same time promoting physical activity.

Another embodiment is a system in which the user interface is an audio system, such as a cassette or disc player and the switch box can turn on and off the audio signal or speaker as a function of the control signal.

Another embodiment is a system in which the user sensory interface has a visual output, such as that on a hand held video game screen and a means to allow the user to view said visual output based on the activity of the user is provided. This means may be a liquid crystal type of shutter that can block the users vision of the screen based on the activity of the user.

Another embodiment is a system in which the user sensory interface is designed with built in control over the audio and/or visual output and is provided with a connection that can be controlled by the activity sensor.

Advantages

The inventive activity activated audio-visual system provides numerous advantages over prior art.

First, it is compatible with existing home audio-video systems and audio-video equipment. The use of expensive or complicated equipment is eliminated. Moreover, it can be easily installed by the user. Because of its simplified nature it is inherently less expensive and more reliable. It maintains physical activity during a normally sedentary activity. It promotes good physical health.

Conclusion, Ramifications, and Scope of Invention

Thus, the reader will see that the activity controlled audio-visual system provides a motivating means for physical activity yet at the same time it is economical and easy to use. Its simplicity allows for a wide range of interesting and motivating applications. It can be easily adapted for a wide variety of activities including exercise, educational, and entertainment uses.

While my above description contains many features, these should not be construed as limitations on the scope of the invention, but rather as exemplifications of the preferred embodiments thereof. Many other variations are possible. For example the system could be used as an educational device and be used to view self-study material which could be learned while doing various activities. Numerous variation of the above described system can occur to those skilled in the art. The commercial implementation of it can be a conversion kit for adapting existing equipment or the invention can be included as part of a complete activity or exercise device. The invention is not limited to that described, rather, the scope of the invention should be determined not by the embodiments discussed, but by the appended claims and their legal equivalents.

I claim:

1. An activity controlled audio-visual system, comprising:

an input signal source generating an input signal;

a user sensory interface, adapted to receive said input signal from said input signal source and present information in said input signal to the user;

a sensor detecting the physical activity of the user and generating a control signal based on the physical activity;

a switch box, connected to said sensor and receiving said control signal, adapted to selectively transmit said input signal to said user sensory interface and block said input signal from reaching said user sensory interface based on said control signal; and wherein when said switch box determines the physical activity is above a predetermined threshold based on said control signal, said switch box transmits said signal to said user sensory interface, and when said sensor determines the physical activity is below a predetermined threshold based on said control signal, said switch box blocks said signal from reaching said user sensory interface.

2. An activity controlled audio-visual system according to claim 1, wherein the sensor and switch box are used to modify an existing user sensory interface and input signal source.

3. An activity controlled audio-visual system according to claim 1, which is attached to a physical exercise device.

4. An activity controlled audio-visual system according to claim 1 wherein at least one of its components, said physical activity device, input signal source, user sensory interface, switch box and sensor are a part of the original equipment manufacture.

5. An activity controlled audio-visual system according to claim 1, said sensor comprising a speed sensor, wherein said control signal indicates a rate at which the exerciser is exercising and wherein said switch box allows said input signal source to be connected to the user sensory interface based on said rate.

6. An activity controlled audio-visual system according to claim 1, wherein said sensor comprises at least one of the combinations of a first and a second elements as a magnetic reed switch and a magnet, a photo-detector and a light source, a magnet and a Hall effect device, a pressure transducer and a pressure source, a mechanical switch and a mechanical actuator, a strain gauge and a deformable support, a flow sensor and a fluid source, a sound transducer and a sound source, wherein when said first element is acted upon by said second element said first element causes a signal to be sent to said switch box.

7. An activity controlled audio-visual system according to claim 1, wherein the on off state of said switch box control is dependant upon at least one of the control factors selected from the group consisting of rate of exercise, and rate of activity, and the force of activity, and the work of activity, and heart rate, and pulse rate, and oxygen consumption, and respiratory rate, and carbon dioxide production, and electrocardiographic information, and electroencephalographic parameters, and electroretinographic data, and galvanic skin response, and sound volume, and sound tone.

8. An activity controlled audio-visual system according to claim 1, wherein control over the parameters used to activate the switch box are adjustable by the user.

9. An activity controlled audio-visual system according to claim 1 wherein control over the parameters used to activate the switch box come are selected in a secure manner controlled by a supervising person.

10. An activity controlled audio-visual system according to claim 1 wherein control parameters of the switch box are at least one of a specific level of activity, a specific time limit, always on, always off or on or off for specific amounts of time or during specific times of the day.

11. An activity controlled audio-visual system according to claim 1, wherein the physical activity comprises at least one of a pedal exerciser, a bicycle, a tread mill, an elliptical cycle, a strength training machine, a rowing machine, a stair climber, a skiing machine, a stepper machine, a weight lifting machine, a resistance training machine, a recumbent cycle, a repetitive task, a physical task, a household chore, playing a musical instrument, and singing.

12. An activity controlled audio-visual system according to claim 1 which information is displayed in a window on the user sensory interface either in a numerical or graphical format and may include rate of activity, duration of activity, speed distance traveled, calories burned.

13. An activity controlled audio-visual system according to claim 1, which is configured as an educational device and used during the display of self-study material.

14. An activity controlled audio-visual system according to claim 1, in which the user interface is a computer wherein the switch box can turn on and off the video monitor as a function of the control signal.

15. An activity controlled audio system according to claim 1, in which the user interface is a telephone wherein the switch box can turn on and off the ability to carry on a conversation as a function of the control signal.

16. An activity controlled audio system according to claim 1, in which the user interface is an audio device wherein the switch box can turn on and off the audio signal or speaker as a function of the control signal.

17. An activity controlled audio-visual system according to claim 1, in which the user sensory interface has a visual output and a means to allow the user to view said visual output based on the activity of the user is provided.

18. An activity controlled audio-visual system, comprising:

a pedal exerciser, having a frame, movable pedals mounted on said frame, a signal source generating an input signal;

a user sensory interface, including at least one of a visual display and an audio speaker, said interface adapted to receive said input signal from said input signal source and present information in said input signal to the user;

a sensor to detect pedal motion of the pedal exerciser, said sensor generating a control signal based on the pedal motion; and a switch box connected to said sensor and receiving said control signal for controlling the signal source in relation to the user sensory interface based on the detected pedal motion, wherein when said switch box determines that the physical activity is above a predetermined threshold based on said control signal, said switch box transmits said input signal to said user sensory interface, and when said sensor determines the physical activity is below a predetermined threshold based on said control signal, said switch box blocks said input signal from reaching said user sensory interface.

* * * * *